US006352036B1

(12) United States Patent
Early

(10) Patent No.: US 6,352,036 B1
(45) Date of Patent: Mar. 5, 2002

(54) PNEUMATIC ACTUATOR FOR RAILROAD CAR COVERS

(75) Inventor: Stephen R. Early, Olathe, KS (US)

(73) Assignee: Aero Transportation Products, Inc., Independence, MO (US)

( * ) Notice: Subject to any disclaimer, the term of this patent is extended or adjusted under 35 U.S.C. 154(b) by 0 days.

(21) Appl. No.: 09/208,727

(22) Filed: Dec. 9, 1998

(51) Int. Cl.[7] ..... B61D 39/00
(52) U.S. Cl. ..... 105/377.06
(58) Field of Search ..... 105/286, 377.01, 105/377.05, 377.06, 377.07; 49/324, 347, 348, 358, 381

(56) References Cited

U.S. PATENT DOCUMENTS

| | | | | |
|---|---|---|---|---|
| 348,856 | A | 9/1886 | Mills | |
| 488,322 | A | 12/1892 | Mills | |
| 2,468,943 | A | 5/1949 | Parsons | |
| 2,864,341 | A | 12/1958 | Novak | |
| 2,976,888 | A | 3/1961 | Merriman | |
| 2,987,004 | A | 6/1961 | Murray | |
| 3,016,884 | A | 1/1962 | Merriman | |
| 3,084,961 | A | 4/1963 | Merriman | |
| 3,121,577 | A | 2/1964 | Merriman | |
| 3,213,923 | A | 10/1965 | Richter | |
| 3,413,856 | A | 12/1968 | Lombardi | |
| 3,476,042 | A | 11/1969 | Carney, Jr. et al. | |
| 3,481,076 | A | * 12/1969 | Bedard | 49/324 |
| 3,848,516 | A | 11/1974 | Merriman | |
| 3,958,368 | A | 5/1976 | Branigan | |
| 3,996,698 | A | 12/1976 | Rees et al. | |
| 4,178,015 | A | 12/1979 | Meriman et al. | |
| 4,854,076 | A | 8/1989 | Sieben et al. | |
| 4,997,347 | A | 3/1991 | Roos | |

OTHER PUBLICATIONS

"Merriman WindJammer Air/Hydromechanical Actuation" Brochure, Merriman Products, Inc. (no date).

* cited by examiner

*Primary Examiner*—Mark T. Le
(74) *Attorney, Agent, or Firm*—Chase & Yakimo, L.C.

(57) ABSTRACT

A railroad car cover actuator automatically opens and closes the hatch covers of a railroad car. The actuator includes a camming device mounted to a railroad car along a longitudinal axis on which a car cover is hingedly mounted. A first inflatable hose for opening the railroad car cover is attached at one end to the cover and at another end to the car and extends partially around the camming device in a taut position when the car cover is closed. A second inflatable hose for closing the railroad car cover is also attached at one and to the cover and at another end to the car and extends from the cover in a relaxed position when the car cover is closed. Upon inflation of either the opening or closing hose, the diameter of the camming device effectively increases because the reach of the hose shortens to apply a lifting force to the cover causing it to open or close, respectively. The actuator may additionally include a pull-strap on each hose for opening or closing the cover upon inflation to prevent permanent deformation of the hoses.

14 Claims, 5 Drawing Sheets

PNEUMATIC ACTUATOR FOR RAILROAD CAR COVERS

FIELD OF THE INVENTION

This invention relates to an actuator system for automatically opening and closing the hatch covers of railroad cars. More specifically, the actuator system can operate at any selected location along a railroad track without the need for a dedicated loading/unloading facility.

BACKGROUND OF THE INVENTION

Railroad cars of various types have been employed for years to transport a variety of materials. For instance, a hopper car typically transports particulate and granular materials, such as grain, and is loaded through one or more hatches in the top of the car. One type of common hopper car presents a continuous trough extending substantially the length of the car which communicates with the top of the car and is closed during transport by a series of longitudinally extending, end-to-end hatch covers. Each cover may be of from eight to thirteen feet in length and weigh on the order of 100 pounds. Other types of railroad cars may also include similar hatch covers that are closed during transport and then opened for loading or unloading.

Obviously, manually opening these covers is very difficult and awkward due to their size, weight and elevated position. It would be advantageous to be able to automatically open the hatch covers of railroad cars remotely at selected locations along the railroad line in case of emergency or otherwise, without the need for a dedicated loading/unloading facility.

Typically, a train is composed of various types of railroad cars having differently configured and constructed hatch openings and covers. Accordingly, it also would be advantageous to be able to automatically open the hatch covers of any combination of cars without requiring manual access.

SUMMARY OF THE INVENTION

Accordingly, it is a primary object of the subject invention to provide a railroad car cover actuator system employing an opening camming device mounted on the car, a first inflatable hose on the camming device for automatically opening an associated cover and a second inflatable hose on a closing camming device for automatically closing the cover.

Another important object of the subject invention is to provide a railroad car cover actuator system having an inflatable opening and closing camming device mounted adjacent a railroad car cover and a strapping member which, when the camming device is inflated, causes the strapping member to automatically swing the cover between an open and a closed position.

Another object of the subject invention is to provide a railroad car cover actuator as aforesaid that includes an opening strap and a closing strap for opening and closing the car cover upon inflation of the camming device.

Yet another object of the subject invention is to provide a railroad car cover actuator that automatically and remotely opens the car's hatch covers at any selected location along the railroad line without the need for a dedicated loading/unloading facility.

Still a further object of the subject invention is to provide a railroad cover actuator that automatically opens the car's hatch covers, eliminating the danger associated with manually opening the covers.

Still a further object of the subject invention is to provide a railroad car cover actuator that is adaptable for use with a variety of railroad car types.

Still another object of the subject invention is to provide a railroad car cover actuator that reduces the labor, expense and time required to open hatch covers.

Yet a further object of the subject invention is to provide a railroad car cover actuator that is cost effective and eliminates the expense and danger of running boards used by workers to access the hatch covers.

Other objects and advantages will become apparent as the description proceeds.

DETAILED DESCRIPTION

Figure 1:
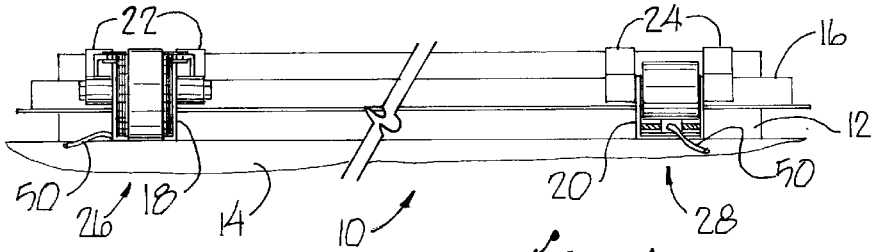
FIG. 1 is a fragmentary, side elevation view of a railroad car cover provided with the actuator system of the present invention, with the car cover closed.
Figure 2:
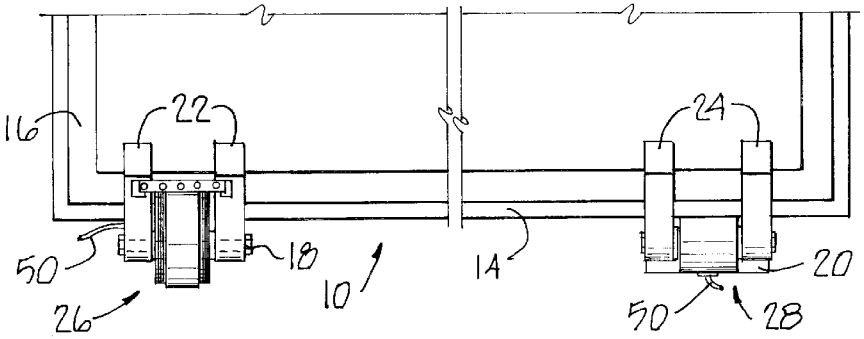
FIG. 2 is a fragmentary, top plan view of the actuator system of FIG. 1.

Referring initially to FIGS. 1 and 2, a railroad car cover actuator system 10 in accordance with the present invention is shown mounted on the top of a railroad car. In the Figures, the railroad car is shown as a hopper car and has a hatch presented by a coaming 12 that extends upwardly from the car's top surface 14. Though not shown, it will be appreciated that the hatch defines a longitudinally extending trough that communicates with the storage compartment of the car therebelow. The hatch is sealed by a hatch cover 16 which is rotatably mounted to upstanding supports 18 and 20 on top surface 14 by hinges 22 and 24 for pivotal movement about a longitudinally extending axis. The hatch cover 16 seals the hatch around the coaming 12.

Figure 5:
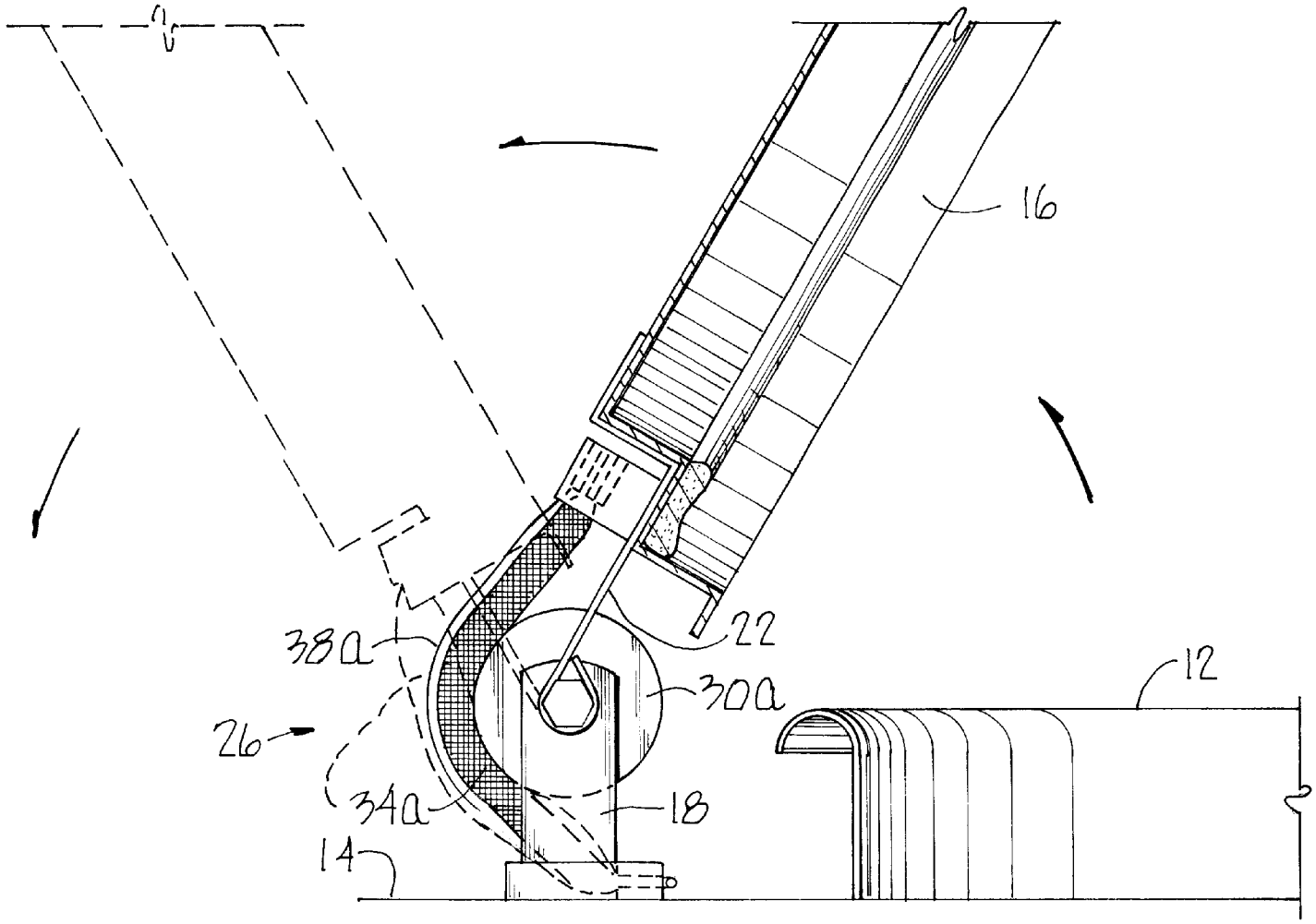
FIG. 5 is an end view illustrating the operation of the opening actuator, showing the opening hose inflated in phantom and the actuator pivoting the car cover from its closed position to its open position.
Figure 6:
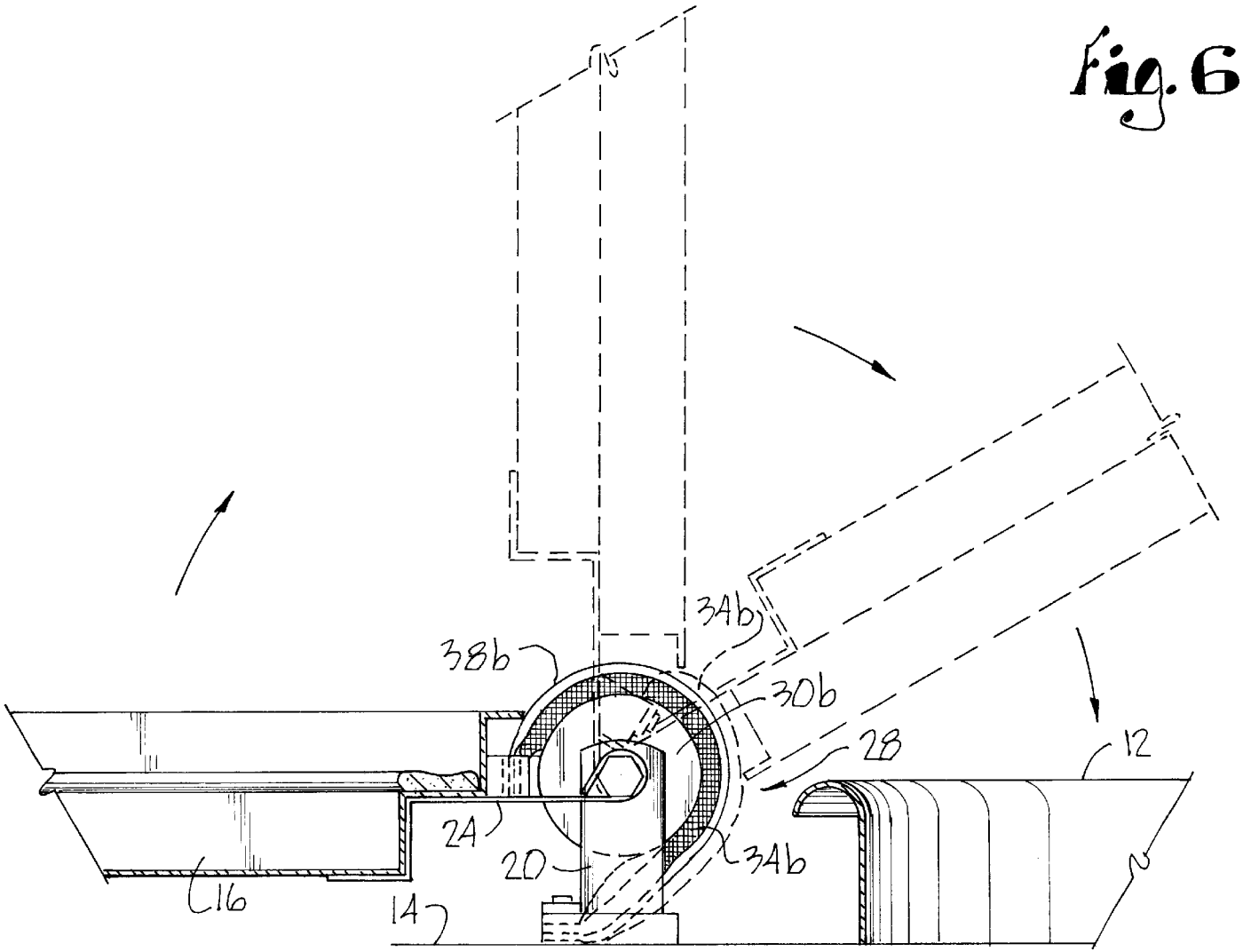
FIG. 6 is an end view illustrating the operation of the closing actuator, showing the closing hose inflated in phantom and the actuator pivoting the car cover from its open position to its closed position.

It should be understood that the actuator system 10 can be used with any type of railroad car employing a hatch cover. As illustrated in FIGS. 5 and 6 and discussed below, upon activation of the actuator system 10, the diameter of an opening actuator 26 or a closing actuator 28 effectively increases applying a lifting force to the hatch cover 16 to cause it to automatically open or close.

Figure 3:
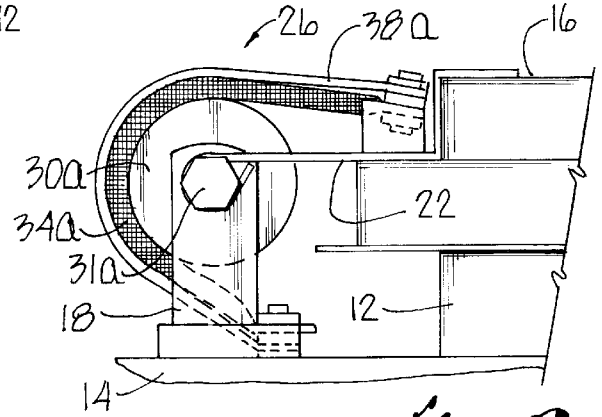
FIG. 3 is an enlarged end view of the opening actuator show in FIG. 1.
Figure 4:
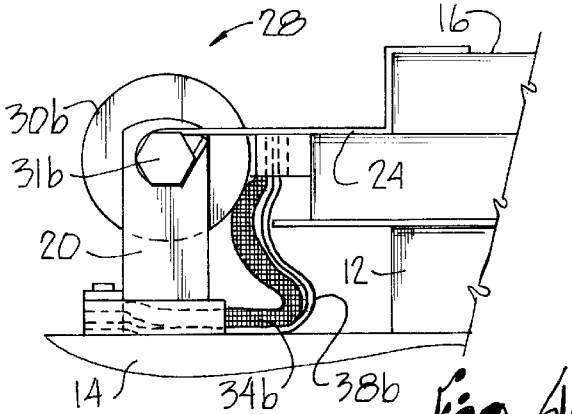
FIG. 4 is an enlarged end view of the closing actuator shown in FIG. 1.

The opening and closing actuators 26 and 28 have several similarities; like components are designated by the same reference numerals with the addition of "a" for the opening actuator 26 and "b" for the closing actuator 28. As seen in FIGS. 3 and 4, they both include a camming wheel or roller 30*a*, 30*b* on an axle 31*a*, 31*b* carried by the corresponding support 18 or 20 and an inflatable hose 34*a,* 34*b* with a pull-strap 38*a,* 38*b* extending thereover. Each of the hoses 34*a*, 34*b* and the pull-straps 38*a,* 38*b* is secured to the hatch cover 16 at one end and to the corresponding support 18 or 20 (or the top surface 14 of the railroad car) at the other end.

Figure 2A:
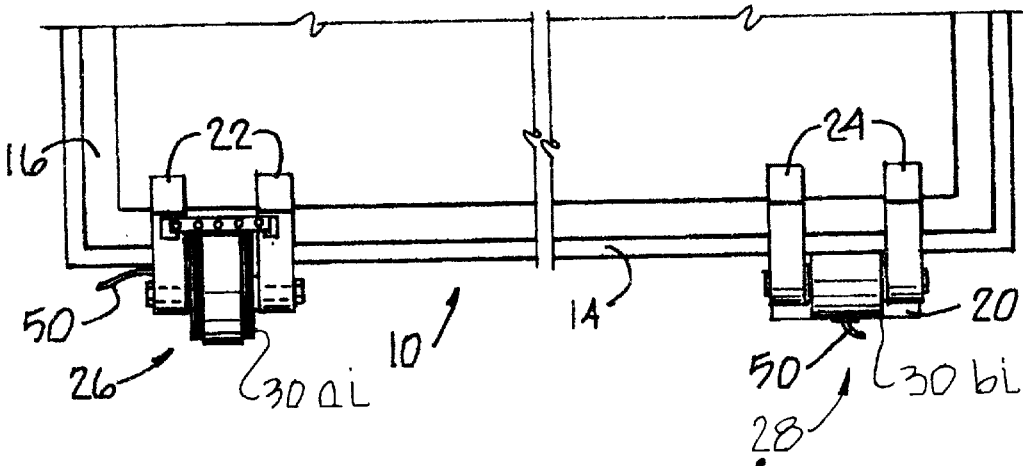
FIG. 2A is a fragmentary, top plan view of the actuator system of an alternative embodiment.

Camming wheels 30*a,* 30*b* are preferably formed of rubber. It is contemplated that the camming wheels could themselves be inflatable, as inflatable camming wheels 30*ai* and 30*bi* shown in FIG. 2A, and thus eliminating the need for hoses 34*a*, 34*b*. Furthermore, although two camming wheels 30*a* and 30*b* are shown, one for each actuator 26 and 28, camming wheels 30*a* and 30*b* could comprise one wheel or roll common to both actuators. Also, although shown as being rotatably mounted, they may be fixedly mounted.

Figure 8:
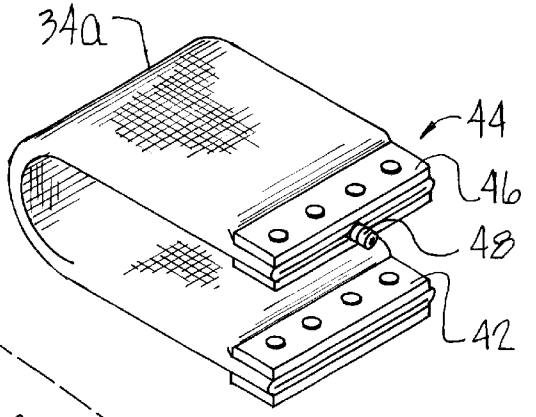
FIG. 8 is a detail perspective view showing the hose and manifold component of each actuator.

As best seen in FIG. 8, hose 34*a* is a flexible walled expandable chamber type hose, generally like a "fire hose" having an inner tube of elastomeric material and an outer cover of woven fabric. The hose ends are sealed by an end fitting 42 and a manifold fitting 44. The manifold fitting 44 includes a manifold portion 46 and a nipple 48 formed integrally therewith and extending therefrom. The hose 34*b* is of identical construction. Air under pressure (or any other appropriate medium, such as water) is supplied via lines 50 connected to nipples 48, the connections being hidden from view in FIGS. 1 and 9.

Figure 7:
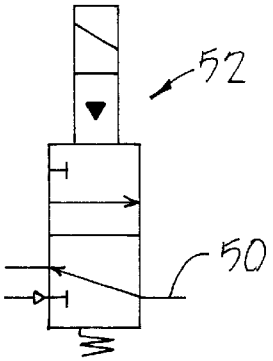
FIG. 7 is a schematic illustrating the control valve used with each actuator unit.

The inflation and deflation of each of the hoses 34*a*, 34*b* is controlled by a separate valve 52 shown schematically in FIG. 7. The valve 52 is a single solenoid, maintained contact, spring return, normally closed three-way valve. Preferably each valve 52 is remotely operated using conventional technology (such as an infrared controller) allowing hatch covers 16 to be opened and closed at various selected locations along a railroad track without the need for a dedicated opening/closing facility.

Pull-straps 38*a* and 38*b* are formed of non-stretchable and preferably flexible material, such as chain link or wire mesh. As shown in the Figures, hoses 34*a*, 34*b* and the corresponding pull-straps 38*a,* 38*b* are coextensive, but the hoses may be shorter if desired. Preferably, pull-straps 38*a,* 38*b* are attached at opposing ends to the hatch cover 16 and the top surface 14 of the railroad car, whether at a support 18 or 20 as shown, or otherwise.

Figure 9:
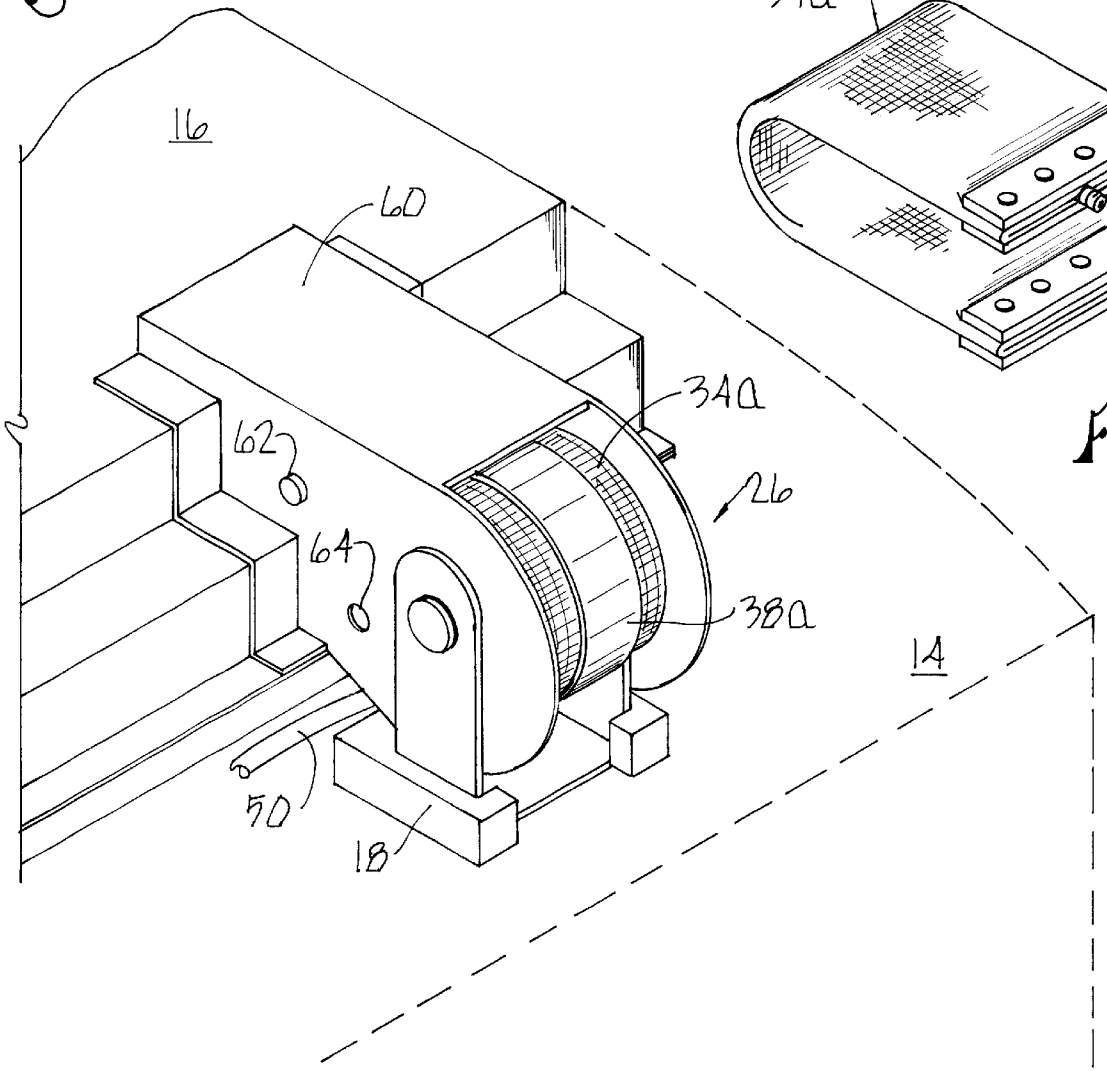
FIG. 9 is a perspective view showing a modified opening actuator.

A protective top shield 60 may also be used with both the opening and closing actuators 26 and 28. FIG. 9 shows the shield 60 secured to the hatch cover 16 over an opening actuator 26. One end of the opening hose 34*a* and pull-strap 38*a* are secured to the shield at cross-pin 62, with the other end of the hose 34*a* and pull-strap 38*a* secured to support 18 as in FIG. 3. When the shield 60 is used with a closing actuator 28, one end of the closing hose 34*b* and pull-strap 38*b* is secured to the shield 60 at aperture 64 by a cross-pin (not shown) with the other ends thereof secured to the support 20, as in FIG. 4. For service or replacement of a worn hose, the cross-pin of the opening or closing actuator may simply be withdrawn to release the hose/pull-strap from the cover.

Now the operation of the opening actuator 26 as shown in FIGS. 3 and 5 will be discussed in more detail. With the hatch cover 16 closed as in FIG. 3, the opening hose 34*a* extends from one end which is secured to a top surface of the hinge 22 in a taut position around the distal side of the camming wheel 30*a* to the hose's opposed end which is secured to the proximal side of the support 18, relative to the hatch cover 16. As shown, the opening pull-strap 38*a* coextends over the opening hose 34*a* and is secured at each end with the corresponding end of the hose 34*a*.

Upon inflation of the hose 34*a*, as shown in phantom in FIG. 5, the reach of the hose 34*a* decreases effectively increasing the diameter of the camming wheel 30*a* and applying a lifting force to the hatch cover 16. The pull-strap 38*a* rotates or swings the cover greater than 90° about the hinge axis. The hose 34*a* is then deflated by operating the associated valve 52 to release the pressure, and the hatch cover 16 completes the 180° swing and falls into the open position.

Now turning to the operation of the closing actuator 28, when the hatch cover 16 is closed as in FIG. 4, the closing hose 34*b* extends from one end which is secured to a bottom surface of the hinge 24 in a relaxed position to the hose's opposed end which is secured to the distal side of the support 20, relative to hatch cover 16. The closing strap 38*b* coextends with the closing hose 34*b* and is secured at each end with the corresponding end of the hose 34*b*.

When the hatch cover 16 is open, as in FIG. 6 (full lines), the closing hose 34*b* and the closing pull-strap 38*b* extend in a taut position around a portion of the camming wheel 30*b* similar to the opening hose and pull-strap 34*a* and 38*a* when the hatch cover 16 is in the closed position. Upon inflation of the closing hose 34*b*, as shown in phantom in FIG. 6, the reach of the hose 34*b* decreases effectively increasing the diameter of the camming wheel 30*b* and applying a lifting force to the hatch cover 16. The pull-strap 38*b* rotates or swings the hatch cover 16 greater than 90° about the hinge axis. Then, upon deflation of the hose 34*b* by opening the associated valve 52, the hatch cover 16 falls into the closed position overlying coaming 12.

Accordingly, it may be appreciated that actuator system 10 may be used with various types of railroad cars employing one or more hatch covers to automatically open and close each of the covers as selected by the operator, thereby eliminating the time, expense and danger of manual opening and closing and the need for a dedicated loading/unloading facility.

What is claimed is:

1. A railroad car cover actuator, comprising:

an inflatable camming device;

means for mounting said device adjacent a railroad car cover;

a strapping member on said device for actuating a railroad car cover, having opposed ends adapted to be secured to the cover and the car, respectively;

means connected to said device for inflating said device to cause said strapping member to swing the cover between an open and a closed position;

said strapping member including an opening strap for opening the car cover upon inflation of said camming device, said opening strap extending around a portion of said camming device in a taut position when the car cover is closed;

said camming device including a camming wheel and an inflatable opening hose on said wheel engageable with said opening strap.

2. A railroad car cover actuator, comprising:

an inflatable camming device;

means for mounting said device adjacent a railroad car cover;

a strapping member on said device for actuating a railroad car cover, having opposed ends adapted to be secured to the cover and the car, respectively;

means connected to said device for inflating said device to cause said strapping member to swing the cover between an open and a closed position;

said strapping member including a closing strap for closing the car cover upon inflation of said camming device, said camming device including a camming wheel and an inflatable opening hose on said wheel engageable with said opening strap.

3. A railroad car actuator as claimed in claim 2, wherein said closing strap extends around a portion of said camming device in a taut position when the car cover is open.

4. A railroad car cover actuator, comprising:

a camming device;

means for rotatably mounting said device to a railroad car along a longitudinal axis on which a car cover is hingedly mounted;

a first inflatable means for opening a railroad car cover, having opposed ends adapted to be secured to the cover and the car respectively, said first inflatable means extending partially around said camming device in a taut position when the car cover is closed;

a second inflatable means for closing the railroad car cover, having opposed ends adapted to be secured to the cover and the car respectively, said second inflatable means having a relaxed position when the car cover is closed; and means connected to said first and second inflatable means for inflating said first inflatable means to open the cover and for inflating said second inflatable means to close the cover.

5. A railroad car cover as claimed in claim 4, wherein each of said first and second inflatable means includes a pull-strap for opening or closing the cover upon inflation.

6. A railroad car cover as claimed in claim 5 wherein each of said first and second inflatable means further includes a hose which inflates to cause the associated pull-strap to open or close the cover upon inflation.

7. A railroad car cover as claimed in claim 4, wherein each of said first and second inflatable means includes an inflatable hose to which said means for inflating is connected.

8. A railroad car cover actuator as claimed in claim 7 wherein said camming device includes two camming wheels, each camming wheel being operably associated with a corresponding hose.

9. A railroad car cover as claimed in claim 4, wherein:

said first inflatable means has a relaxed position when the car cover is open;

said second inflatable means extends partially around said camming device in a taut position when the car cover is open.

10. In combination with a railroad car having a hatch cover, apparatus for opening and closing the cover comprising:

an inflatable camming device;

means for mounting said device to said railroad car along a longitudinal axis on which said cover is hingedly mounted;

a strapping member on said device for actuating said car cover, having opposed ends secured to said car cover and said railroad car, respectively; and means connected to said device for inflating said device to cause said strapping member to open said cover or to cause said strapping member to close said cover, said camming device including a camming wheel and an inflatable opening hose on said wheel engageable with said strapping member.

11. In combination with a railroad car having a hatch cover, apparatus for opening and closing the cover comprising:

an inflatable camming device;

means for mounting said device to said railroad car along a longitudinal axis on which said cover is hingedly mounted;

a strapping member on said device for actuating said car cover, having opposed ends secured to said car cover and said railroad car, respectively; and means connected to said device for inflating said device to cause said strapping member to open said cover or to cause said strapping member to close said cover, said camming device including a camming wheel and an inflatable closing hose on said wheel engageable with said strapping member.

12. In combination with a railroad car having a hatch cover, apparatus for opening and closing the cover comprising:

an inflatable camming device;

means for mounting said device to said railroad car along a longitudinal axis on which said cover is hingedly mounted;

a strapping member on said device for actuating said car cover, having opposed ends secured to said car cover and said railroad car, respectively; and means connected to said device for inflating said device to cause said strapping member to open said cover or to cause said strapping member to close said cover, said strapping member including an opening strap for opening said cover upon inflation of said camming device and a closing strap for closing said cover upon inflation of said camming device, said opening strap extending around a portion of said camming device in a taut position when said car cover is closed and said closing strap having a relaxed position adjacent said device when said car cover is closed.

13. The combination as claimed in claim 12 wherein said camming device includes an inflatable camming wheel.

14. The combination as claimed in claim 12 wherein said camming device includes an inflatable opening camming wheel and an inflatable closing camming wheel.

* * * * *